US010618283B2

(12) United States Patent
Kasahara et al.

(10) Patent No.: US 10,618,283 B2
(45) Date of Patent: Apr. 14, 2020

(54) PIEZOELECTRIC DEVICE, LIQUID DISCHARGE HEAD, AND LIQUID DISCHARGE APPARATUS

(71) Applicant: Seiko Epson Corporation, Tokyo (JP)

(72) Inventors: Takashi Kasahara, Shiojiri (JP); Masao Nakayama, Shiojiri (JP); Takeshi Saito, Matsumoto (JP); Yoshihiro Hokari, Azumino (JP); Toshihiro Shimizu, Fujimi (JP); Naoto Yokoyama, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/225,107

(22) Filed: Dec. 19, 2018

(65) Prior Publication Data

US 2019/0193401 A1 Jun. 27, 2019

(30) Foreign Application Priority Data

Dec. 25, 2017 (JP) ..... 2017-247354

(51) Int. Cl.
*B41J 2/14* (2006.01)
*B41J 2/16* (2006.01)

(52) U.S. Cl.
CPC ..... *B41J 2/14233* (2013.01); *B41J 2/1433* (2013.01); *B41J 2/161* (2013.01);
(Continued)

(58) Field of Classification Search
CPC ..... B41J 2/14201; B41J 2/14209; B41J 2/14233; B41J 2002/14217;
(Continued)

(56) References Cited

U.S. PATENT DOCUMENTS

2010/0245492 A1 9/2010 Li
2013/0278673 A1* 10/2013 Takeuchi ..... B41J 2/1433 347/33

(Continued)

FOREIGN PATENT DOCUMENTS

JP 11-227190 A 8/1999
JP 2004-209874 A 7/2004

(Continued)

*Primary Examiner* — Kristal Feggins

(74) *Attorney, Agent, or Firm* — Harness, Dickey & Pierce, P.L.C.

(57) ABSTRACT

A piezoelectric device includes a pressure chamber forming substrate in which a pressure chamber empty portion is formed, a vibrating plate that is formed on the pressure chamber forming substrate, corresponding to the pressure chamber empty portion, and a piezoelectric element that is formed on the vibrating plate, corresponding to the pressure chamber empty portion, in which the vibrating plate is provided with a concave portion having a bottom portion which is overlapped with the pressure chamber empty portion, and is larger than the pressure chamber empty portion in a planar view, and a wall portion which surrounds the bottom portion, on the pressure chamber empty portion side, the wall portion has a curved surface that is inclined to widen in a direction toward the pressure chamber empty portion from the bottom portion, and a curvature radius of the curved surface is 60 nm to 1000 nm.

7 Claims, 11 Drawing Sheets

(52) U.S. Cl.
CPC ..... *B41J 2/162* (2013.01); *B41J 2/1623* (2013.01); *B41J 2/1626* (2013.01); *B41J 2/1628* (2013.01); *B41J 2/1629* (2013.01); *B41J 2/1642* (2013.01); *B41J 2/1646* (2013.01); *B41J 2002/14241* (2013.01)

(58) Field of Classification Search
CPC ..... B41J 2002/1425; B41J 2/1646; B41J 2/1642; B41J 2/1433; B41J 2/161; B41J 2002/14241
See application file for complete search history.

(56) References Cited

U.S. PATENT DOCUMENTS

| | | | | |
|---|---|---|---|---|
| 2017/0087843 | A1 | 3/2017 | Mikoshiba et al. | |
| 2017/0113462 | A1 | 4/2017 | Takahashi et al. | |
| 2018/0086069 | A1* | 3/2018 | Kakiuchi ..... | H01L 41/0475 |
| 2018/0339513 | A1* | 11/2018 | Yamasaki ..... | H01L 41/0973 |

FOREIGN PATENT DOCUMENTS

| | | | |
|---|---|---|---|
| JP | 2010-221434 | A | 10/2010 |
| JP | 2010-228275 | A | 10/2010 |
| JP | 2017-061089 | A | 3/2017 |
| JP | 2017-080946 | A | 5/2017 |

* cited by examiner

| No. | DIMENSION OF PIEZOELECTRIC DEVICE | RELATIVE DISPLACEMENT MAGNITUDE | |
|---|---|---|---|
| | NOZZLE DENSITY [npi] | CENTER PORTION DISPLACEMENT | END PORTION DISPLACEMENT |
| 1 | 120 | 1 | 0.017 |
| 2 | 240 | 2 | 0.069 |
| 3 | 300 | 2.5 | 0.107 |
| 4 | 600 | 5 | 0.429 |

FIG. 14

| No. | CONDITION OF PIEZOELECTRIC DEVICE | | | | | BONDING STRENGTH OF VIBRATING PLATE | |
|---|---|---|---|---|---|---|---|
| | PITCH INTERVAL A [ μm ] | WIDTH OF PRESSURE CHAMBER B [ μm ] | WIDTH OF PARTITION WALL C (C=A−B) [ μm ] | CURVATURE RADIUS D [ nm ] | BONDING WIDTH OF VIBRATING PLATE E (E=C−2×D) [ μm ] | RATIO OF BONDING WIDTH TO PARTITION WALL F (F=E / C) [ μm ] | DETERMINATION |
| 1 | 42.3 | 37.0 | 5.3 | 60 | 5.2 | 98% | A |
| 2 | 42.3 | 37.0 | 5.3 | 300 | 4.7 | 89% | A |
| 3 | 42.3 | 37.0 | 5.3 | 400 | 4.5 | 85% | A |
| 4 | 42.3 | 37.0 | 5.3 | 1000 | 3.3 | 63% | A |
| 5 | 42.3 | 37.0 | 5.3 | 1200 | 2.9 | 55% | B |
| 6 | 42.3 | 37.0 | 5.3 | 1500 | 2.3 | 44% | C |

PIEZOELECTRIC DEVICE, LIQUID DISCHARGE HEAD, AND LIQUID DISCHARGE APPARATUS

The entire disclosure of Japanese Patent Application No. 2017-247354, filed Dec. 25, 2017 is expressly incorporated by reference herein.

BACKGROUND

1. Technical Field

The present invention relates to a piezoelectric device, a liquid discharge head including the piezoelectric device, and a liquid discharge apparatus including the liquid discharge head.

2. Related Art

As a representative example of a liquid discharge head, an ink jet type recording head that discharges ink droplets from a nozzle is cited. In the ink jet type recording head, a portion of a pressure chamber communicating with the nozzle which discharges the ink droplets is formed of a vibrating plate, the vibrating plate is deformed by a piezoelectric element, and an ink of the pressure chamber is pressurized, thereby, the ink droplets are discharged from the nozzle (for example, JP-A-2004-209874).

An ink jet type recording head (liquid discharge head) that is disclosed in JP-A-2004-209874 includes a piezoelectric element, a pressure generating chamber (pressure chamber), and a vibrating plate which forms a portion of the pressure chamber, and a concave portion is formed on the pressure chamber side of the vibrating plate. That is, the concave portion which functions as a vibrating plate is provided, and an impact which is generated in the vibrating plate at the time of pressure generation is cushioned or eliminated by a whole structure of the vibrating plate, thereby, durability of the liquid discharge head is improved.

In recent years, a demand for improving high performance of the liquid discharge head such that the liquid discharge head is refined and highly densified is raised. If the liquid discharge head is refined and highly densified, a volume within the pressure chamber becomes small, and thus, there is a need to greatly displace the vibrating plate in order to obtain a predetermined discharge amount. However, there are problems that the vibrating plate is likely to deteriorate if a displacement magnitude of the vibrating plate becomes large, and the vibrating plate (liquid discharge head) is likely to deteriorate due to a drive over a long period of time in a case of merely providing the concave portion in the vibrating plate.

SUMMARY

The invention can be realized in the following aspects or application examples.

Application Example 1

According to this application example, there is provided a piezoelectric device including a substrate in which a space is formed, an elastic layer that is formed on the substrate, corresponding to the space, and a piezoelectric element that is formed on the elastic layer, corresponding to the space, in which the elastic layer is provided with a concave portion having a bottom portion which is overlapped with the space, and is larger than the space in a planar view, and a wall portion which surrounds the bottom portion, on the space side, the wall portion has a curved surface that is inclined to widen in a direction toward the space from the bottom portion, and a curvature radius of the curved surface is 60 nm to 1000 nm.

The elastic layer covers the space of the substrate, and is provided with the concave portion in a portion which is overlapped with the space in a planar view, and on a circumference of the portion which is overlapped with the space in a planar view. The concave portion has the curved surface of which the curvature radius is 60 nm to 1000 nm, on the circumference (wall portion) of the portion (bottom portion) which is overlapped with the space in a planar view.

The elastic layer is capable of being displaced in the portion which is overlapped with the space in a planar view, and on the circumference of the portion which is overlapped with the space in a planar view, and the elastic layer vibrates (is displaced), by driving the piezoelectric device. In this case, the curved surface (wall portion) of which the curvature radius is 60 nm to 1000 nm is used as a supporting point, and the elastic layer vibrates, thereby, stress which is generated in a case where the elastic layer vibrates is concentrated on the curved surface. That is, the curved surface of which the curvature radius is 60 nm to 1000 nm is provided in a portion on which the stress that is generated in a case where the elastic layer vibrates is concentrated.

Thereupon, a spot on which the stress that is generated in a case where the elastic layer vibrates is concentrated is distributed by spreading out the curved surface, an adverse effect (for example, fatigue failure of the elastic layer) of the stress concentration is less likely to be generated in comparison with a case where the stress is concentrated at a specific spot, and the elastic layer is less likely to deteriorate due to the drive over a long period of time, thereby, it is possible to improve the durability of the elastic layer. Accordingly, the durability of the elastic layer is improved, thereby, it is possible to realize high reliability of the piezoelectric device.

Application Example 2

In the piezoelectric device according to the application example, it is preferable that a portion of the curved surface be covered with a resin.

Since the portion (curved surface) on which the stress that is generated in a case where the elastic layer vibrates is concentrated is covered with the resin, and is reinforced by the resin, the adverse effect (for example, fatigue failure of the elastic layer) of the stress concentration is less likely to be generated in comparison with a case where the portion on which the stress is concentrated is not covered with the resin, thereby, it is possible to improve the durability of the elastic layer.

Application Example 3

In the piezoelectric device according to the application example, it is preferable that the substrate be formed with a plurality of the spaces side by side, and the number of the spaces per one inch be 300 or more and 600 or less.

If the number of spaces per one inch is 300 or more and 600 or less, the elastic layer is less likely to deteriorate due to the drive over a long period of time even in the piezoelectric device which is densified, thereby, it is possible to improve the durability of the elastic layer.

Application Example 4

According to this application example, there is provided a liquid discharge head including the piezoelectric device described in the above-described application examples, in which a liquid with which the space is filled is discharged, by a drive of the piezoelectric element.

In the piezoelectric device according to the above-described application examples, the durability of the elastic layer is improved, thereby, the piezoelectric device has high reliability. Accordingly, the liquid discharge head including the piezoelectric device described in the above-described application examples has high reliability.

Application Example 5

According to this application example, there is provided a liquid discharge apparatus including the liquid discharge head described in the above-described application examples.

In the liquid discharge head according to the above-described application examples, the durability of the elastic layer is improved, thereby, the liquid discharge head has high reliability. Accordingly, the liquid discharge apparatus including the liquid discharge head described in the above-described application examples has high reliability.

BRIEF DESCRIPTION OF THE DRAWINGS

The invention will be described with reference to the accompanying drawings, wherein like numbers reference like elements.

FIG. 14 is a table illustrating a relationship between a condition of the piezoelectric device and bonding strength of the vibrating plate.

DESCRIPTION OF EXEMPLARY EMBODIMENTS

Hereinafter, embodiments of the invention will be described with reference to the drawings. Such an embodiment illustrates one embodiment of the invention, does not limit the invention, and is capable of being optionally modified within the scope of a technical idea of the invention. In each of the following drawings, a scale of each layer or each portion is made be different from an actual value, in order to make each layer and each portion have a size which is capable of being approximately recognized on the drawings.

First Embodiment

Figure 1:
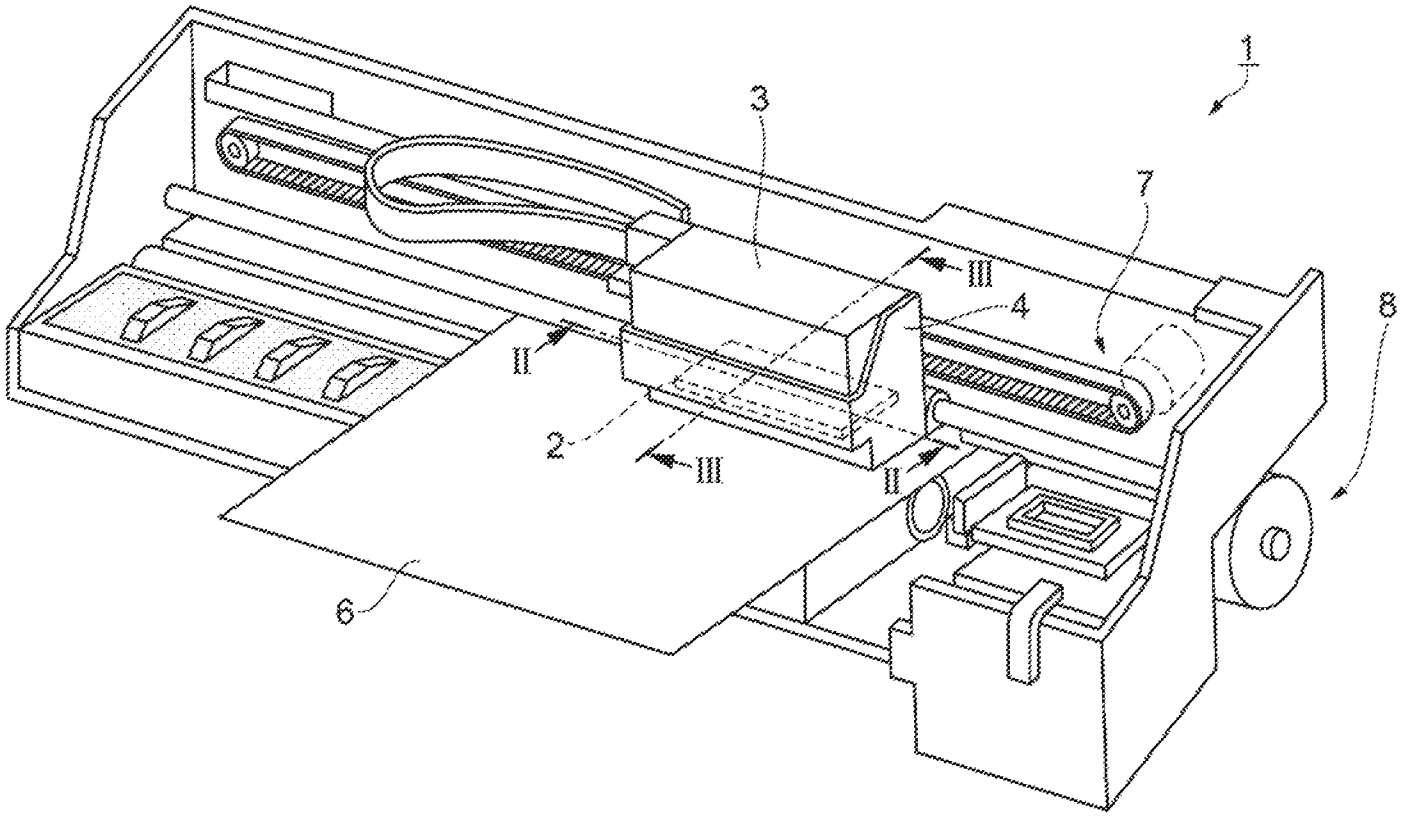
FIG. 1 is a perspective view illustrating an inner configuration of a printer according to a first embodiment.

FIG. 1 is a perspective view illustrating an inner configuration of a printer according to a first embodiment.

First, an outline of a printer 1 according to the first embodiment will be described, with reference to FIG. 1.

As illustrated in FIG. 1, the printer 1 according to the first embodiment is an example of a "liquid discharge apparatus", and includes a carriage 4 to which a recording head 2 as an example of a "liquid discharge head" and an ink cartridge 3 as a liquid supply source are detachably attached, a carriage moving mechanism 7 that moves the carriage 4 in a reciprocating manner in a paper width direction of a recording paper 6, that is, in a main scanning direction, and a paper feeding mechanism 8 that transports the recording paper 6 in a sub scanning direction which is orthogonal to the main scanning direction. The carriage 4 is configured to be moved by the carriage moving mechanism 7 in the main scanning direction. The printer 1 records a character, an image, or the like on the recording paper 6 while sequentially transporting the recording paper 6 in the sub scanning direction, and while moving the carriage 4 in a reciprocating manner in the main scanning direction.

It is possible to adopt not only a configuration in which the ink cartridge 3 is attached to the carriage 4, but also a configuration in which the ink cartridge 3 is disposed on a main body side of the printer 1, and an ink is supplied to the recording head 2 side through an ink supply tube.

Figure 2:
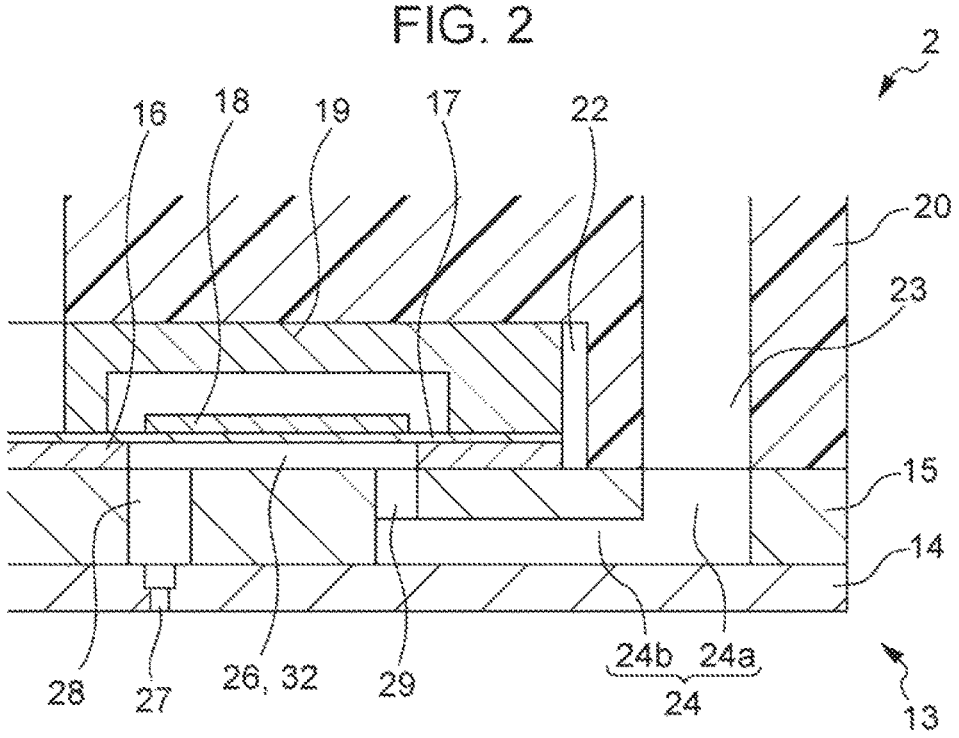
FIG. 2 is a sectional view taken along II-II line in FIG. 1.
Figure 3:
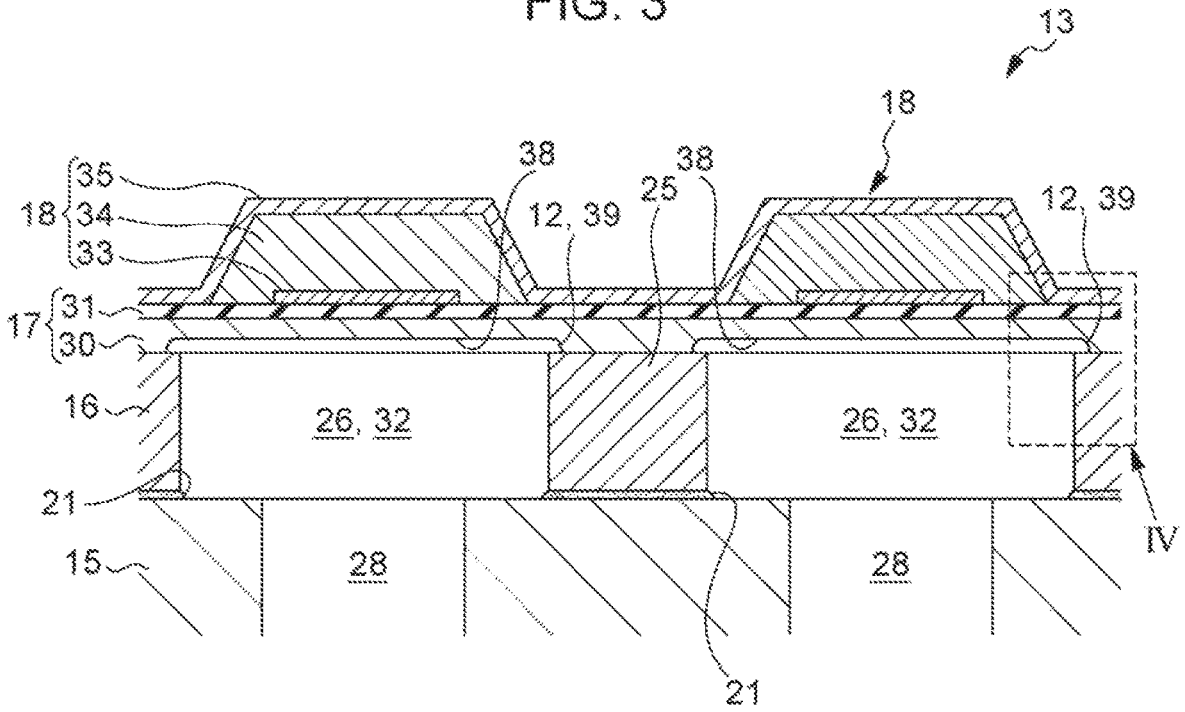
FIG. 3 is a sectional view taken along III-III line in FIG. 1.
Figure 4:
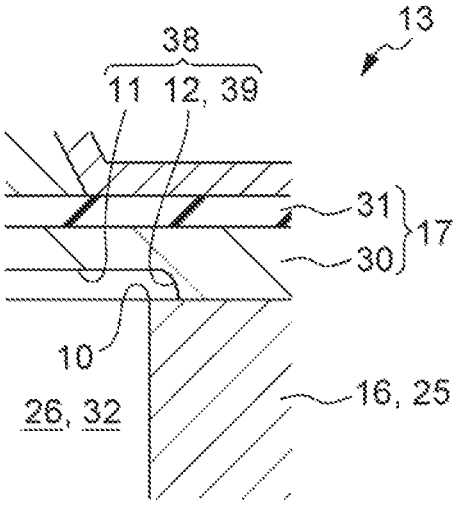
FIG. 4 is an enlarged view of a region IV which is surrounded by a broken line in FIG. 3.

FIG. 2 is a sectional view taken along II-II line in FIG. 1, and is a sectional view illustrating an inner configuration of the recording head 2. FIG. 3 is a sectional view taken along III-III line in FIG. 1, and is a sectional view of a main portion in a nozzle array direction of a piezoelectric device 13. FIG. 4 is an enlarged view of a region IV which is surrounded by a broken line in FIG. 3.

A direction along II-II line in FIG. 1 is the main scanning direction, and FIG. 2 is a sectional view of the recording head 2 along the main scanning direction. A direction along III-III line in FIG. 1 is the sub scanning direction, and FIG. 3 is a sectional view of the recording head 2 along the sub scanning direction.

Next, an outline of the recording head 2 will be described, with reference to FIGS. 2 to 4.

As illustrated in FIGS. 2 to 4, the recording head 2 in the first embodiment is formed of the piezoelectric device 13 and a case 20. The recording head 2 (piezoelectric device 13) discharges the ink with which a pressure chamber 26 (pressure chamber empty portion 32) is filled, due to a drive of a piezoelectric element 18.

The piezoelectric device 13 is bonded to a bottom surface side (lower surface) of the case 20.

The piezoelectric device 13 has a configuration in which a plurality of substrates, specifically, a nozzle plate 14, a communicating substrate 15, and a pressure chamber forming substrate 16 that is an example of the "substrate" are stacked in this sequence, and are bonded to each other by an adhesive 21 to form a unit. A vibrating plate 17 as an example of an "elastic layer", and the piezoelectric element 18 (one kind of an actuator) are stacked on a surface which is opposite to the communicating substrate 15 side in the pressure chamber forming substrate 16. In the piezoelectric device 13, a protective substrate 19 that protects the piezoelectric element 18 is bonded to an upper surface of the vibrating plate 17.

In other words, the vibrating plate 17 corresponds to the pressure chamber 26 (pressure chamber empty portion 32), and is formed on the pressure chamber forming substrate 16. The piezoelectric element 18 corresponds to the pressure chamber 26 (pressure chamber empty portion 32), and is formed on the vibrating plate 17.

The case 20 is a box body-shaped member which is made of a synthetic resin, in which the piezoelectric device 13 is fixed on the bottom surface side. An accommodation empty portion 22 which becomes hollow in a rectangular parallelepiped shape up to a middle in a height direction of the case 20 from the lower surface, is formed on the lower surface side of the case 20. If the piezoelectric device 13 is bonded to the lower surface, the pressure chamber forming substrate 16, the vibrating plate 17, the piezoelectric element 18, and the protective substrate 19 in the piezoelectric device 13 are accommodated into the accommodation empty portion 22. An ink introduction path 23 is formed in the case 20. The ink from the ink cartridge 3 side is introduced into a common liquid chamber 24 of a layer-stacked structure through the ink introduction path 23.

The pressure chamber forming substrate 16 is manufactured from a silicon single crystalline substrate (simply referred to as a silicon substrate, hereinafter). In the pressure chamber forming substrate 16, a plurality of pressure chamber empty portions 32 (equivalent to spaces in the application of the invention) that divide the pressure chambers 26 correspond to respective nozzles 27 of the nozzle plate 14, and are formed by anisotropic etching. That is, the pressure chamber empty portion 32 which is an example of the "space" is formed in the pressure chamber forming substrate 16. The pressure chamber forming substrate 16 is manufactured from a silicon substrate of which an upper surface and a lower surface are (110) planes, and the pressure chamber empty portion 32 is a through hole of which a side surface (inner wall) is (111) plane. An opening portion on one side (upper surface side) of the pressure chamber empty portion 32 in the pressure chamber forming substrate 16 is sealed by the vibrating plate 17. The communicating substrate 15 is bonded to a surface which is opposite to the vibrating plate 17 in the pressure chamber forming substrate 16, and an opening portion on the other side (lower surface side) of the pressure chamber empty portion 32 is sealed by the communicating substrate 15. Thereby, the pressure chamber 26 is divided and formed.

Here, a portion of dividing one surface of the pressure chamber 26 by sealing an upper opening of the pressure chamber 26 in the vibrating plate 17, is a movable region which is displaced due to the drive of the piezoelectric element 18.

It is possible to adopt a configuration in which the pressure chamber forming substrate 16 and the vibrating plate 17 are integrated. That is, an etching treatment is carried out from the lower surface side of the pressure chamber forming substrate 16, and the pressure chamber empty portion 32 is formed by leaving a thin wall portion of which a board thickness is small on the upper surface side, thereby, it is possible to adopt a configuration in which the thin wall portion functions as a movable region.

The pressure chamber 26 is an empty portion having a long length in a direction which is orthogonal to a parallel disposition direction of the nozzles 27. One end portion in a longitudinal direction of the pressure chamber 26 communicates with the nozzle 27 through a nozzle communicating port 28 of the communicating substrate 15. The other end portion in the longitudinal direction of the pressure chamber 26 communicates with the common liquid chamber 24 through an individual communicating port 29 of the communicating substrate 15. A plurality of pressure chambers 26 are disposed in parallel by corresponding to each of the nozzles 27, and being partitioned with a partition wall 25 (see FIG. 3) along the nozzle array direction. That is, the plurality of pressure chambers 26 (pressure chamber empty portions 32) are formed to correspond to the nozzles 27 at a ratio of 1:1.

The communicating substrate 15 is a board material which is manufactured from a silicon substrate, in the same manner as the pressure chamber forming substrate 16. In the communicating substrate 15, an empty portion which becomes the common liquid chamber 24 (also referred to as a reservoir or manifold) that is provided in common in the plurality of pressure chambers 26 of the pressure chamber forming substrate 16 is formed by anisotropic etching. The common liquid chamber 24 is an empty portion having a long length along the parallel disposition direction of each pressure chamber 26. The common liquid chamber 24 is formed of a first liquid chamber **24*a* which passes through in the board thickness direction of the communicating substrate 15, and a second liquid chamber 24*b* which is formed in a state of leaving the thin wall portion on the upper surface side up to the middle in the board thickness direction of the communicating substrate 15 toward the upper surface side from the lower surface side of the communicating substrate 15. One end portion (end portion of a side which is distant from the nozzle 27) of the second liquid chamber 24*b* communicates with the first liquid chamber 24*a*, meanwhile, the other end portion (end portion of a side which is close to the nozzle 27) of the second liquid chamber 24*b* is formed at a position corresponding to a lower side of the pressure chamber 26. In the other end portion of the second liquid chamber 24***b*, that is, in the end portion which is opposite to the first liquid chamber 24*a* side, a plurality of individual communicating ports 29 penetrating the thin wall portion are formed by corresponding to each pressure chamber 26 of the pressure chamber forming substrate 16. A lower end of the individual communicating port 29 communicates with the second liquid chamber 24*b*, and an upper end of the individual communicating port 29 communicates with the pressure chamber 26 of the pressure chamber forming substrate 16.

The nozzle plate 14 is manufactured from a silicon substrate, and a plurality of nozzles 27 are formed in an array shape. An ink flow path which is from the common liquid chamber 24 through the individual communicating port 29, the pressure chamber 26, and the nozzle communicating port 28 to the nozzle 27, is formed in the piezoelectric device 13.

For example, the vibrating plate 17 which is formed on the upper surface of the pressure chamber forming substrate 16, is formed of an elastic film 30 that is made of an silicon oxide ($SiO_2$), and an insulating film 31 that is made of a zirconium oxide ($ZrO_2$). A concave portion 38 having a bottom portion 11 which is overlapped with the pressure chamber 26 (pressure chamber empty portion 32), and is larger than the pressure chamber 26 (pressure chamber empty portion 32) in a planar view, and a wall portion 12 which surrounds the bottom portion 11, on the pressure chamber 26 (pressure chamber empty portion 32) side, is provided in the elastic film 30 of the vibrating plate 17. The wall portion 12 has a curved surface 39 that is inclined to widen in a direction which is toward the pressure chamber 26 (pressure chamber empty portion 32) from the bottom portion 11.

In other words, the vibrating plate 17 is provided with the concave portion 38 having the bottom portion 11 which is overlapped with the pressure chamber empty portion 32, and is larger than the pressure chamber empty portion 32 in a planar view, and the wall portion 12 which surrounds the bottom portion 11, on the pressure chamber empty portion 32 side, and the wall portion 12 has the curved surface 39 that is inclined to widen in the direction which is toward the space (pressure chamber empty portion 32) from the bottom portion 11. Therefore, a dimension L1 (see FIG. 9 (referred to as an inner dimension L1, hereinafter)) of the concave portion 38 in the sub scanning direction, is longer than a dimension L2 (see FIG. 9 (referred to as an inner dimension L2, hereinafter)) of the pressure chamber 26 in the sub scanning direction.

The piezoelectric element 18 is formed at a position corresponding to the upper opening of the pressure chamber 26 in the vibrating plate 17, that is, on the movable region of the vibrating plate 17. The piezoelectric element 18 is formed by sequentially stacking a lower electrode 33, a piezoelectric object 34, and an upper electrode 35 in sequence from the vibrating plate 17 side. The lower electrode 33 is patterned per pressure chamber 26, and functions as an individual electrode of the piezoelectric element 18. The upper electrode 35 is formed in series along the parallel disposition direction of each pressure chamber 26, and functions as a common electrode of the plurality of piezoelectric elements 18. In the piezoelectric element 18, a region where the piezoelectric object 34 is interposed by the upper electrode 35 and the lower electrode 33 is a piezoelectric active portion in which piezoelectric strain is generated by applying a voltage to both electrodes. Hereinafter, the piezoelectric element 18 means the piezoelectric active portion. Therefore, the piezoelectric element 18 is deformed in a bending manner in accordance with a change of an applied voltage, thereby, the movable region of the vibrating plate 17 which divides one surface of the pressure chamber 26 is displaced on a side approaching the nozzle 27, or in a direction which becomes distant from the nozzle 27. Thereby, a pressure change is generated in the ink within the pressure chamber 26, and the ink is discharged from the nozzle 27 due to the pressure change.

Due to such a configuration, in the printer 1, an operation of forming a dot by discharging the ink to the recording paper 6 from the nozzle 27 while moving the carriage 4 in the main scanning direction, and an operation of moving the recording paper 6 in the sub scanning direction are repeated, thereby, the image is printed in the recording paper 6.

A density of the nozzles 27 which are formed in the nozzle plate 14, and a density of the pressure chambers 26 (pressure chamber empty portions 32) which are formed in the pressure chamber forming substrate 16 are proportional to a density of the dots which are formed in the recording paper 6.

FIGS. 5 to 9 are diagrams corresponding to FIG. 3, and are outline diagrams illustrating a state of the piezoelectric device. In FIGS. 5 to 9, one of the plurality of pressure chambers 26 or piezoelectric elements 18 is illustrated in the drawing.

Next, a method for manufacturing the piezoelectric device 13 will be described, with reference to FIGS. 5 to 9.

Figure 5:
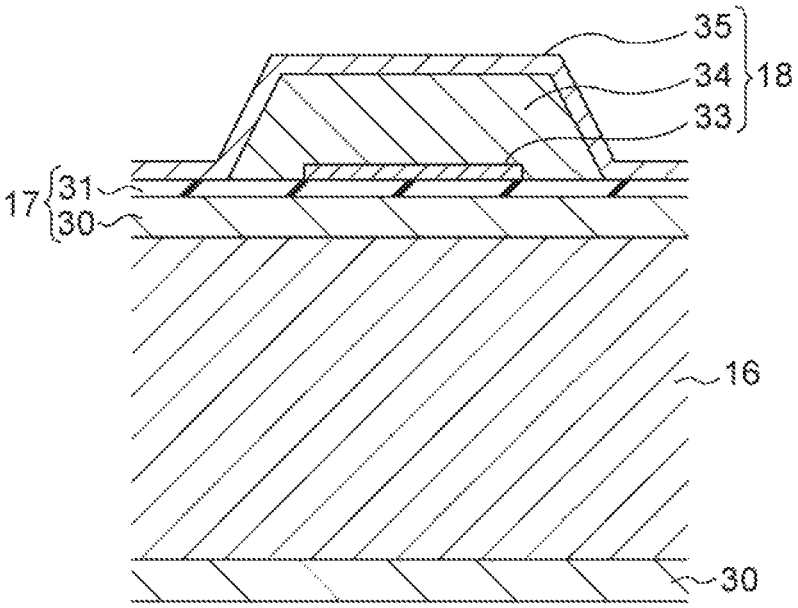
FIG. 5 is an outline diagram illustrating a state of a piezoelectric device.

As illustrated in FIG. 5, in a process of manufacturing the piezoelectric device 13, first, the elastic film 30 is formed on a surface of the silicon substrate which is a material of the pressure chamber forming substrate 16. In detail, the surface of the silicon substrate is thermally oxidized, thereby, the elastic film 30 which is made of the silicon oxide ($SiO_2$) is formed. Subsequently, for example, after a zirconium layer (Zr) is formed on the elastic film 30 by sputtering or the like, the insulating film 31 which is made of the zirconium oxide ($ZrO_2$) is formed by being thermally oxidized. Therefore, the vibrating plate 17 which is formed of the elastic film 30 and the insulating film 31 is formed.

An adhesion layer which is made of a metal material such as iridium may be formed on the insulating film 31, as necessary.

The vibrating plate 17 which is formed of the elastic film 30 and the insulating film 31 is formed on the upper surface of the pressure chamber forming substrate 16, and thereafter, the lower electrode 33, the piezoelectric object 34, and the upper electrode 35 are sequentially stacked on the vibrating plate 17, thereby, the piezoelectric element 18 is formed.

Next, the other surface (lower surface) that is opposite to one surface on the side where the vibrating plate 17 and the piezoelectric element 18 are formed in the pressure chamber forming substrate 16 is polished, thereby, a thickness of the pressure chamber forming substrate 16 is adjusted, and thereafter, the space (pressure chamber empty portion 32) which becomes the pressure chamber 26 is formed by anisotropic etching, for example, using an etching solution which is made of a potassium hydroxide aqueous solution (KOH), with respect to the pressure chamber forming substrate 16.

Figure 6:
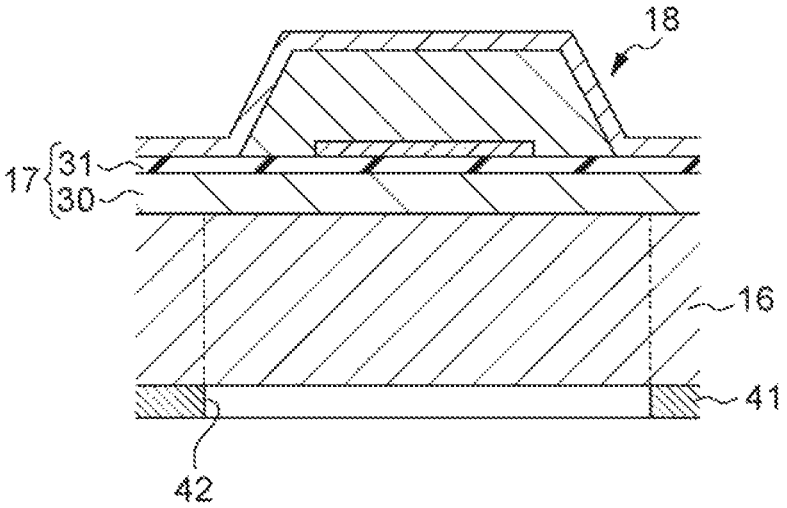
FIG. 6 is an outline diagram illustrating the state of the piezoelectric device.
Figure 7:
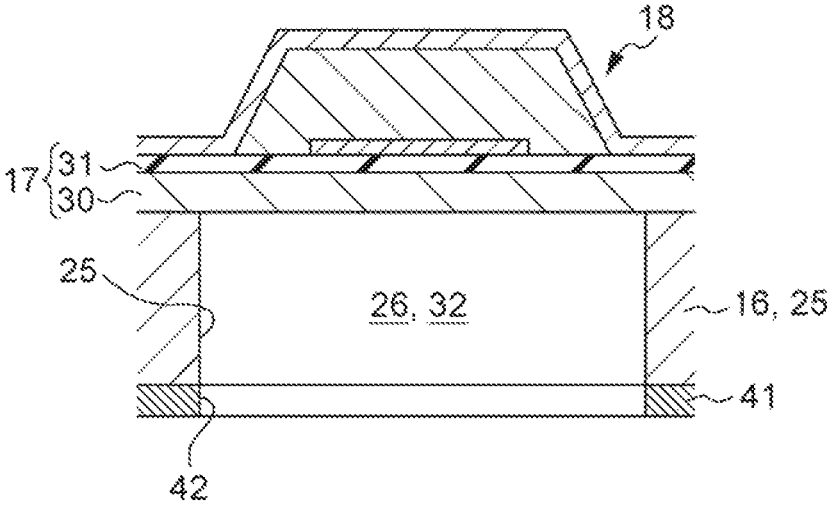
FIG. 7 is an outline diagram illustrating the state of the piezoelectric device.

Specifically, as illustrated in FIG. 6, a mask 41 is formed by a CVD method or a sputtering method, on the lower surface of the pressure chamber forming substrate 16. As a mask 41, for example, a silicon nitride (SiN) is used. In a portion corresponding to the pressure chamber 26 in the mask 41, an opening 42 is formed by dry etching or the like. A portion which is indicated by a broken line in the pressure chamber forming substrate 16 of FIG. 6 is a formation intended spot of the pressure chamber 26. In this state, the pressure chamber forming substrate 16 is anisotropically etched with the etching solution (potassium hydroxide aqueous solution) described above. Since an etching rate of the KOH to the (111) plane is very low in comparison with the etching rate of the KOH to the (110) plane, the etching advances in the thickness direction of the pressure chamber forming substrate 16, and the pressure chamber 26 (pressure chamber empty portion 32) of which the side surface (inner wall) is the (111) plane is formed, as illustrated in FIG. 7.

In the pressure chamber forming substrate 16, a portion which is etched and removed with the KOH becomes the pressure chamber empty portion 32, and a portion which is not etched with the KOH becomes the partition wall 25.

Subsequently, the mask 41 is removed using hydrofluoric acid (HF).

Figure 8:
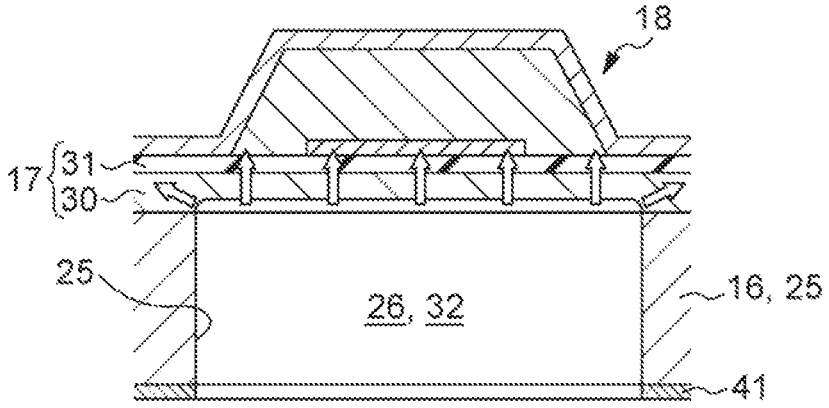
FIG. 8 is an outline diagram illustrating the state of the piezoelectric device.
Figure 9:
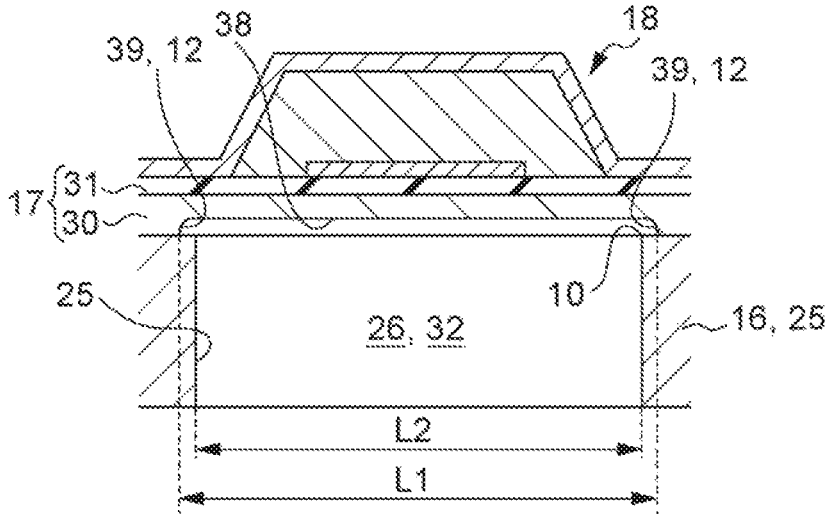
FIG. 9 is an outline diagram illustrating the state of the piezoelectric device.

As illustrated in FIGS. 8 and 9, at the time of removing the mask 41 using hydrofluoric acid, continuously, the elastic film 30 that is the silicon oxide which is exposed in the pressure chamber 26 is etched, thereby, the concave portion 38 is formed on the pressure chamber 26 side of the elastic film 30. While the elastic film 30 is exposed to the hydrofluoric acid, the side etching of the elastic film 30 advances, thereby, the curved surface 39 (wall portion 12) is formed. That is, the concave portion 38 having the curved surface 39 (wall portion 12) is formed in the vibrating plate 17.

The hydrofluoric acid isotropically etches the elastic film 30 (silicon oxide) without etching the pressure chamber forming substrate 16 (silicon). Therefore, the elastic film 30 is isotropically etched with the hydrofluoric acid, thereby, the concave portion 38 is formed in the elastic film 30 (vibrating plate 17). Since the pressure chamber forming substrate 16 is not etched, and the elastic film 30 is isotropically etched, the curved surface 39 (wall portion 12) having a cross section of a circular shape (arc shape) with an end portion 10 of the pressure chamber forming substrate 16 as a center is formed in the concave portion 38. A curvature radius of the curved surface 39 in the wall portion 12 is expressed by (inner dimension L1−inner dimension L2)/2 (see FIGS. 4 and 9).

In the application of the invention, the "curvature radius of the curved surface" is a radius of an approximated circle obtained by approximating a contour (curve) of the cross section of the curved surface 39 to a circle. A shape of the cross section of the curved surface 39 in the wall portion 12 may be the circular shape (arc shape) described above, or may be, for example, an elliptical shape.

It is possible to control the curvature radius of the curved surface 39 by etching time of the elastic film 30 with the hydrofluoric acid. For example, if the elastic film 30 is large in thickness, and the etching time of the elastic film 30 with the hydrofluoric acid is lengthened, the curvature radius of the curved surface 39 becomes large. If the etching time of the elastic film 30 with the hydrofluoric acid is shortened, the curvature radius of the curved surface 39 becomes small.

That is, the etching time of the elastic film 30 with the hydrofluoric acid is controlled, thereby, it is possible to the curved surface 39 (wall portion 12) having a predetermined curvature radius.

Although the detailed description is omitted, the common liquid chamber 24, the individual communicating port 29, the nozzle communicating port 28, and the like are formed by anisotropic etching, in the communicating substrate 15. On the other hand, the nozzle 27 is formed by dry etching, in the nozzle plate 14. Therefore, in a state of determining a position such that the nozzle 27 and the nozzle communicating port 28 communicate with each other, the communicating substrate 15 and the nozzle plate 14 are bonded by the adhesive 21.

For example, the concave portion 38 of the elastic film 30, and the inner wall of the flow path such as the pressure chamber 26 may be covered with a protective film of which a configuration material is a tantalum oxide ($Ta_2O_5$), a silicon oxide ($SiO_2$), or the like.

Figures 10, 11:
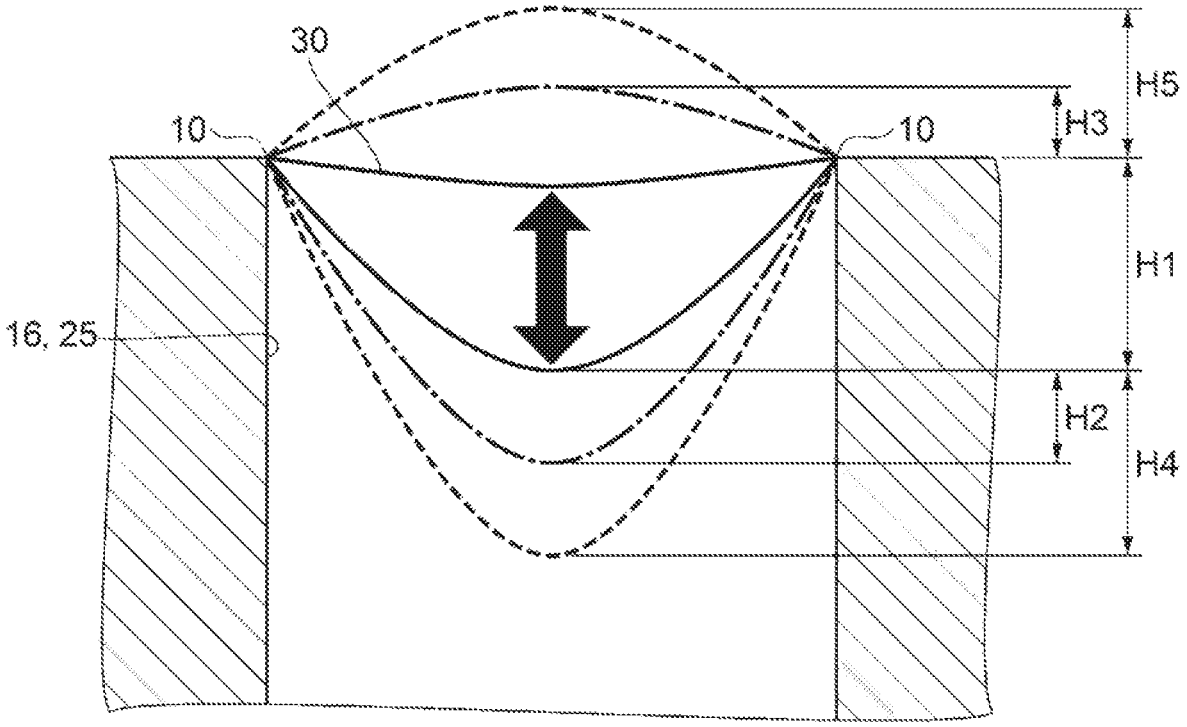
FIG. 10 is a table illustrating a relationship between a dimension of the piezoelectric device and a relative displacement magnitude of a vibrating plate at the time of discharging ink droplets of the same amounts.
FIG. 11 is a schematic diagram illustrating a state of the vibrating plate in a case where the piezoelectric element is driven in a state of filling a pressure chamber with an ink.

FIG. 10 is a table illustrating a relationship between a dimension of the piezoelectric device and a relative displacement magnitude of the vibrating plate at the time of discharging ink droplets of the same amounts. FIG. 11 is a diagram corresponding to FIG. 3, and is a schematic diagram illustrating a state of the vibrating plate in a case where the piezoelectric element is driven in a state of filling the pressure chamber with the ink.

In FIG. 10, the nozzle density is the number of the nozzles 27 which are formed in the piezoelectric device 13, per one inch, and a unit of the nozzle density is npi (nozzle per inch). Center portion displacement of FIG. 10 is the displacement at a center of the movable region of the vibrating plate 17, and is the displacement of the vibrating plate 17 at a position which is separated as (½)L2 from the partition wall 25 illustrated in FIG. 9. End portion displacement of FIG. 10 is the displacement of the vibrating plate 17 in the vicinity of the end portion 10 illustrated in FIG. 9.

In FIG. 10, the displacement magnitude of the center portion displacement of which the nozzle density is 120 npi is indicated as 1, and the displacement magnitude (displacement magnitude of the center portion displacement or displacement magnitude of the end portion displacement) in each nozzle density is indicated as a relative displacement magnitude, by a relative value with respect to the displacement magnitude of the center portion displacement of which the nozzle density is 120 npi.

In FIG. 11, the partition wall 25 and the vibrating plate 17 are illustrated, and the illustration of other configuration components is omitted. In FIG. 11, a solid line indicates a state of the vibrating plate 17 in a case of being not filled with the ink. In FIG. 11, a one-dot chain line indicates a state of the vibrating plate 17 in a case of being filled with the ink, and at the time of discharge stability. In FIG. 11, a broken line indicates a state of the vibrating plate 17 in a case of being filled with the ink, and at the time of discharge instability.

Next, problems which the piezoelectric device 13 has will be described, with reference to FIGS. 10 and 11.

As illustrated in FIG. 10, in a case where the nozzle density is 120 npi, the relative displacement magnitude of the center portion displacement is 1, and the relative displacement magnitude of the end portion displacement is 0.017.

In a case where the nozzle density is 240 npi, the relative displacement magnitude of the center portion displacement is 2, and the relative displacement magnitude of the end portion displacement is 0.069. Therefore, in a case where the ink droplets of the same amounts are discharged, the vibrating plate 17 is displaced largely as two times at the center portion in the piezoelectric device 13 of which the nozzle density is 240 npi in comparison with the piezoelectric device 13 of which the nozzle density is 120 npi, and there is a need to displace the vibrating plate 17 largely as 4.1 times in the vicinity of the end portion 10.

In a case where the nozzle density is 300 npi, the relative displacement magnitude of the center portion displacement is 2.5, and the relative displacement magnitude of the end portion displacement is 0.107. Therefore, in a case where the ink droplets of the same amounts are discharged, the vibrating plate 17 is displaced largely as 2.5 times at the center portion in the piezoelectric device 13 of which the nozzle density is 300 npi in comparison with the piezoelectric device 13 of which the nozzle density is 120 npi, and there is a need to displace the vibrating plate 17 largely as 6.3 times in the vicinity of the end portion 10.

In a case where the nozzle density is 600 npi, the relative displacement magnitude of the center portion displacement is 5, and the relative displacement magnitude of the end portion displacement is 0.429. Therefore, in a case where the ink droplets of the same amounts are discharged, the vibrating plate 17 is displaced largely as five times at the center portion in the piezoelectric device 13 of which the nozzle density is 600 npi in comparison with the piezoelectric device 13 of which the nozzle density is 120 npi, and there is a need to displace the vibrating plate 17 largely as 25.2 times in the vicinity of the end portion 10.

In this manner, if the nozzle density of the piezoelectric device 13 becomes high density of 120 npi, 240 npi, 300 npi, or 600 npi, in a case where the ink droplets of the same amounts are discharged, the relative displacement magnitude of the vibrating plate 17 becomes large. That is, since a volume of the pressure chamber 26 becomes small if the nozzle density is highly densified, there is a need to displace the vibrating plate 17 largely in order to obtain a predetermined discharge amount. Regarding the change of the relative displacement magnitude of the vibrating plate 17 in a case where the nozzle density is highly densified, a value of the end portion displacement (displacement of the vibrating plate 17 in the vicinity of the end portion 10) is larger than that of the center portion displacement (displacement at the center of the movable region of the vibrating plate 17). Therefore, large stress is applied to the vibrating plate 17 (end of the movable region of the vibrating plate 17) in the vicinity of the end portion 10, in comparison with the center of the movable region of the vibrating plate 17, and the vibrating plate 17 (end of the movable region of the vibrating plate 17) in the vicinity of the end portion 10 is likely to deteriorate.

In particular, since the vibrating plate 17 in the vicinity of the end portion 10 of which the nozzle density is 600 npi is displaced largely as 25.2 times in comparison with the vibrating plate 17 in the vicinity of the end portion 10 of which the nozzle density is 120 npi, the vibrating plate 17 is likely to early deteriorate. Furthermore, since the vibrating plate 17 in the vicinity of the end portion 10 of which the nozzle density is 300 npi is displaced largely as 6.3 times in comparison with the vibrating plate 17 in the vicinity of the end portion 10 of which the nozzle density is 120 npi, the vibrating plate 17 in the vicinity of the end portion 10 is likely to early deteriorate.

Accordingly, since the vibrating plate 17 in the vicinity of the end portion 10 is likely to deteriorate in a case where the nozzle density is 300 npi or more and 600 npi or less, the piezoelectric device 13 has the problem that durability as a target is less likely to be realized.

As illustrated by the solid line in FIG. 11, in a case where the piezoelectric element 18 is driven by a known drive method (for example, a Pull-Push-Pull method or the like) in a state of not filling the pressure chamber 26 with the ink, the movable region of the vibrating plate 17 is displaced on the side approaching the nozzle 27, or in the direction which becomes distant from the nozzle 27. In this case, the displacement magnitude of the vibrating plate 17 is H1.

As illustrated by the one-dot chain line in FIG. 11, in a case where the piezoelectric element 18 is driven by a known drive method (for example, a Pull-Push-Pull method or the like) in a state of filling the pressure chamber 26 with the ink, the vibrating plate 17 is largely displaced on the side approaching the nozzle 27, or in the direction which becomes distant from the nozzle 27, in comparison with the state of not filling the pressure chamber 26 with the ink. That is, in comparison with a case where the drive is performed in the state of not filling the pressure chamber 26 with the ink, the vibrating plate 17 is largely displaced, and so-called overshoot displacement is generated. The overshoot displacement is a phenomenon that the vibrating plate 17 is largely displaced due to inertial force of the ink or the pressure change of the pressure chamber 26, in comparison with the state of not filling the pressure chamber 26 with the ink. In this case, an overshoot amount on a side where the vibrating plate 17 approaches the nozzle 27 is H2, and an overshoot amount on a side where the vibrating plate 17 is separated from the nozzle 27 is H3.

If the piezoelectric element 18 is driven in a state in which bubbles are not mixed into the pressure chamber 26 or the nozzle 27, and the vibrating plate 17 is displaced as illustrated by the one-dot chain line in FIG. 11, a desired ink droplet is discharged from the nozzle 27.

The state in which the bubbles are not mixed into the pressure chamber 26 or the nozzle 27 is a state in which a desired ink droplet is discharged from the nozzle 27, and is referred to as time of discharge stability, hereinafter. On the other hand, a state in which the bubbles are mixed into the pressure chamber 26 or the nozzle 27 is a state in which a desired ink droplet is not discharged from the nozzle 27, and is referred to as time discharge instability, hereinafter.

If the bubbles are mixed into the pressure chamber 26 or the nozzle 27, flow path resistance of the ink flow path and inertia (inertance) of a fluid are lowered, and a concern that a desired ink droplet is not discharged from the nozzle 27 is generated. In a case where the flow path resistance is lowered, attenuation of residual pressure vibration of the pressure chamber 26 after a drive waveform is applied becomes small. In a case where the inertance is lowered, a pressure vibration cycle becomes short. In this case, if a known drive waveform (for example, a Pull-Push-Pull method) is applied, the vibrations of the plurality of pressure chambers 26 are synthesized, and the overshoot displacement of the vibrating plate 17 is made larger, in comparison with that at the time of discharge stability.

In detail, as illustrated by the broken line in FIG. 11, at the time of discharge instability at which the bubbles are mixed into the pressure chamber 26 or the nozzle 27, the vibrating plate 17 is further largely displaced on the side approaching the nozzle 27, or in the direction which becomes distant from the nozzle 27, in comparison with that at the time of discharge stability at which the bubbles are not mixed into the pressure chamber 26 or the nozzle 27. In this case, the overshoot amount on the side where the vibrating plate 17 approaches the nozzle 27 is H4, and the overshoot amount on the side where the vibrating plate 17 is separated from the nozzle 27 is H5.

That is, on the side where the vibrating plate 17 approaches the nozzle 27, the overshoot amount H4 at the time of discharge instability is larger than the overshoot amount H2 at the time of discharge stability. On the side where the vibrating plate 17 is separated from the nozzle 27, the overshoot amount H5 at the time of discharge instability is larger than the overshoot amount H3 at the time of discharge stability.

In this manner, since the vibrating plate 17 at the time of discharge instability is further largely displaced in comparison with that at the time of discharge stability, and the stress which is applied to the vibrating plate 17 in the vicinity of the end portion 10 becomes large, the vibrating plate 17 deteriorates earlier. Since printing performance is lowered in a case where the discharge is not stable, that is, in a case where the bubbles are mixed into the pressure chamber 26 or the nozzle 27, a maintenance treatment of forcibly exhausting the bubbles from the pressure chamber 26 or the nozzle 27 is carried out, and the state is recovered to the state in which the discharge is not stable, that is, the state in which the bubbles are not mixed into the pressure chamber 26 or the nozzle 27.

However, it is difficult to remove a period in which the bubbles are mixed into the pressure chamber 26 or the nozzle 27, and the piezoelectric device 13 may be used in the state in which the discharge is not stable. Therefore, in order to realize the durability which is the target of the piezoelectric device 13, it is preferable that the vibrating plate 17 have the durability as a target in a case where the discharge is not stable (case where the bubbles are mixed into the pressure chamber 26 or the nozzle 27), in addition to a case where the discharge is stable (case where the bubbles are not mixed into the pressure chamber 26 or the nozzle 27).

FIGS. 12A to 12D are schematic diagrams illustrating a state of the stress which is applied to the vibrating plate, in a case where the piezoelectric element is driven at the time of discharge stability. FIG. 13 is a diagram illustrating a relationship between the curvature radius of the curved surface of the concave portion and relative stress (relative stress value) which is applied to the end portion of the vibrating plate. FIG. 14 is a table illustrating a relationship between a condition of the piezoelectric device and bonding strength (bonding strength of the vibrating plate to the partition wall, in detail) of the vibrating plate.

In FIGS. 12A to 12D, and FIG. 13, the stress that is applied to the vibrating plate 17 in the piezoelectric device 13 of which the nozzle density is 600 npi is evaluated by simulation. The simulation is also applied to other devices, and validity is verified.

In FIG. 14, the bonding strength of the vibrating plate 17 to the partition wall 25 is evaluated, with respect to the piezoelectric device 13 of which the nozzle density is 600 npi.

Figure 12A:
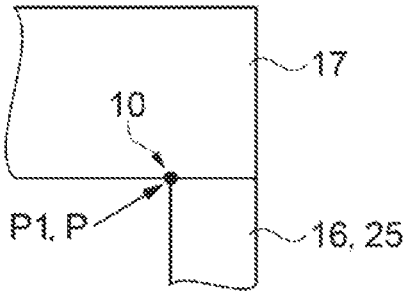
FIG. 12A is a schematic diagram illustrating a state of stress which is applied to the vibrating plate in a case where the piezoelectric element is driven at the time of discharge stability.
Figure 12B:
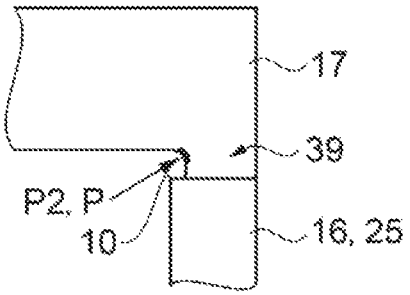
FIG. 12B is a schematic diagram illustrating the state of the stress which is applied to the vibrating plate in a case where the piezoelectric element is driven at the time of discharge stability.
Figure 12C:
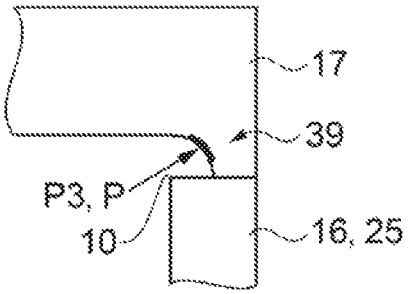
FIG. 12C is a schematic diagram illustrating the state of the stress which is applied to the vibrating plate in a case where the piezoelectric element is driven at the time of discharge stability.
Figure 12D:
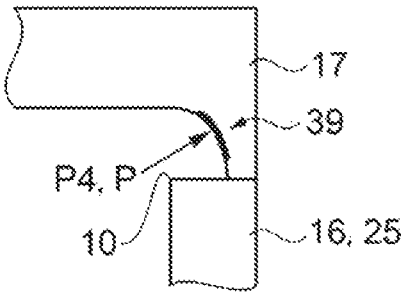
FIG. 12D is a schematic diagram illustrating the state of the stress which is applied to the vibrating plate in a case where the piezoelectric element is driven at the time of discharge stability.
Figure 13:
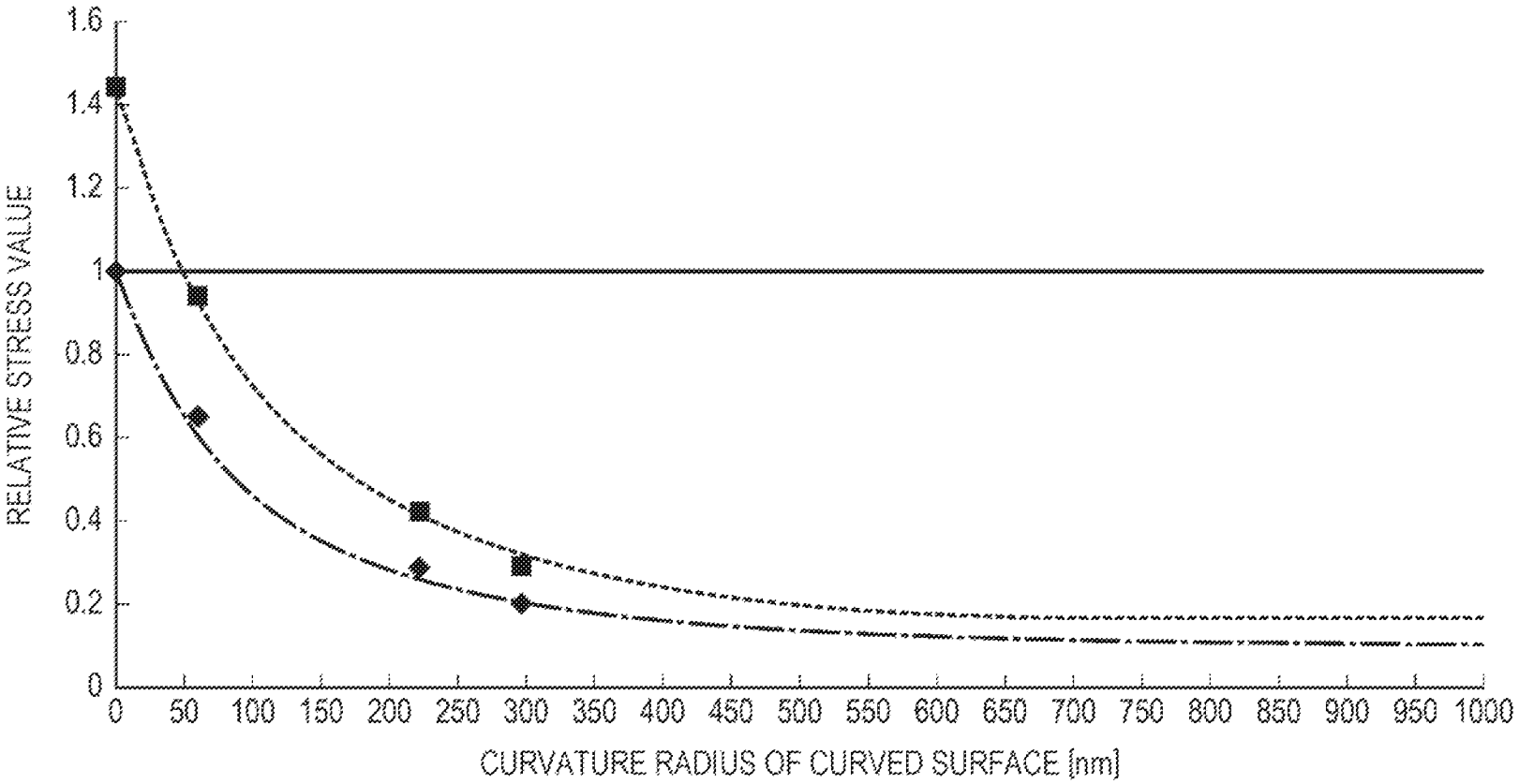
FIG. 13 is a diagram illustrating a relationship between a curvature radius of a curved surface of a concave portion and a relative stress value which is applied to an end portion of the vibrating plate.

In FIGS. 12A to 12D, in a case where the curvature radius of the curved surface 39 is changed, the state of the stress which is applied to the vibrating plate 17 is evaluated by the simulation, and a portion P of the vibrating plate 17 to which the stress is applied in a concentrated manner is indicated by black solid printing. In detail, in FIG. 12A, in a case where the curvature radius of the curved surface 39 is 0 nm, a portion P1 of the vibrating plate 17 to which the stress is applied in a concentrated manner is indicated by black solid printing (black circle). In FIG. 12B, in a case where the curvature radius f the curved surface 39 is 60 nm, a portion P2 of the vibrating plate 17 to which the stress is applied in a concentrated manner is indicated by black solid printing. In FIG. 12C, in a case where the curvature radius of the curved surface 39 is 144 nm, a portion P3 of the vibrating plate 17 to which the stress is applied in a concentrated manner is indicated by black solid printing. In FIG. 12D, in a case where the curvature radius of the curved surface 39 is 294 nm, a portion P4 of the vibrating plate 17 to which the stress is applied in a concentrated manner is indicated by black solid printing.

In FIG. 13, a vertical axis represents the relative stress value (relative stress value which is applied to the vibrating plate 17 in the vicinity of the end portion 10), and a horizontal axis represents the curvature radius of the curved surface 39. A relationship between the curvature radius of the curved surface 39 at the time of discharge stability and the relative stress value is indicated by a one-dot chain line, and a relationship between the curvature radius of the curved surface 39 at the time of discharge instability and the relative stress value is indicated by a broken line.

As illustrated in FIG. 12A, in a case where the curvature radius of the curved surface 39 is 0 nm, the portion P1 of the vibrating plate 17 to which the stress is applied in a concentrated manner is positioned at the end of the movable region (portion which is not bonded to the partition wall 25) of the vibrating plate 17. That is, the portion P1 of the vibrating plate 17 to which the stress is applied in a concentrated manner is positioned in the vicinity of the end portion 10 in the pressure chamber forming substrate 16. In this manner, in a case where the curvature radius of the curved surface 39 is 0 nm, the stress is applied to a specific portion (portion P1) of the vibrating plate 17 in a concentrated manner, and an adverse effect (for example, fatigue failure) of the stress concentration on the vibrating plate 17 is most likely to be generated.

As illustrated in FIG. 12B, in a case where the curvature radius of the curved surface 39 is 60 nm, the portion P2 of the vibrating plate 17 to which the stress is applied in a concentrated manner is positioned on the curved surface 39 of the vibrating plate 17. The portion P2 of the vibrating plate 17 to which the stress is applied in a concentrated manner in a case where the curvature radius of the curved surface 39 is 60 nm becomes large in comparison with the portion P1 of the vibrating plate 17 to which the stress is applied in a concentrated manner in a case where the curvature radius of the curved surface 39 is 0 nm, and the adverse effect (for example, fatigue failures) of the stress concentration on the vibrating plate 17 is cushioned.

As illustrated in FIG. 12C, in a case where the curvature radius of the curved surface 39 is 144 nm, the portion P3 of the vibrating plate 17 to which the stress is applied in a concentrated manner is positioned on the curved surface 39 of the vibrating plate 17. The portion P3 of the vibrating plate 17 to which the stress is applied in a concentrated manner in a case where the curvature radius of the curved surface 39 is 144 nm becomes large in comparison with the portion P2 of the vibrating plate 17 to which the stress is applied in a concentrated manner in a case where the curvature radius of the curved surface 39 is 60 nm, and the adverse influence (for example, fatigue failure) of the stress concentration on the vibrating plate 17 is further cushioned.

As illustrated in FIG. 12D, in a case where the curvature radius of the curved surface 39 is 294 nm, the portion P4 of the vibrating plate 17 to which the stress is applied in a concentrated manner is positioned on the curved surface 39 of the vibrating plate 17. The portion P4 of the vibrating plate 17 to which the stress is applied in a concentrated manner in a case where the curvature radius of the curved surface 39 is 294 nm becomes large in comparison with the portion P3 of the vibrating plate 17 to which the stress is applied in a concentrated manner in a case where the curvature radius of the curved surface 39 is 144 nm, and the adverse influence (for example, fatigue failure) of the stress concentration on the vibrating plate 17 is most cushioned, and is most likely to be generated.

In this manner, in the piezoelectric device 13 of which the nozzle density is 600 npi, an area of the portion P to which the stress of the vibrating plate 17 is applied in a concentrated manner becomes large in sequence of a case where the curvature radius of the curved surface 39 is 0 nm, a case where the curvature radius of the curved surface 39 is 60 nm, a case where the curvature radius of the curved surface 39 is 144 nm, and a case where the curvature radius of the curved surface 39 is 294 nm. In accordance with a case where the portion P of the vibrating plate 17 to which the stress is applied in a concentrated manner becomes large, the fatigue failure of the portion of the vibrating plate 17 to which the stress is applied in a concentrated manner is less likely to be generated, the durability of the vibrating plate 17 is improved, and the durability (reliability) of the piezoelectric device 13 is improved.

Even in the piezoelectric device 13 (piezoelectric device 13 in which the nozzles are formed at a low density) of which the nozzle density is smaller than 600 npi, the area of the portion P to which the stress of the vibrating plate 17 is applied in a concentrated manner becomes large in sequence of a case where the curvature radius of the curved surface 39 is 0 nm, a case where the curvature radius of the curved surface 39 is 60 nm, a case where the curvature radius of the curved surface 39 is 144 nm, and a case where the curvature radius of the curved surface 39 is 294 nm, in the same manner as the piezoelectric device 13 of which the nozzle density is 600 npi, the fatigue failure of the portion of the vibrating plate 17 is less likely to be generated in this sequence, and the durability of the vibrating plate 17 is improved.

Even in the piezoelectric device 13 (piezoelectric device 13 in which the nozzles are formed at a high density) of which the nozzle density is larger than 600 npi, the area of the portion P to which the stress of the vibrating plate 17 is applied in a concentrated manner becomes large in sequence of a case where the curvature radius of the curved surface 39 is 0 nm, a case where the curvature radius of the curved surface 39 is 60 nm, a case where the curvature radius of the curved surface 39 is 144 nm, and a case where the curvature radius of the curved surface 39 is 294 nm, in the same manner as the piezoelectric device 13 of which the nozzle density is 600 npi, the fatigue failure of the portion of the vibrating plate 17 is less likely to be generated in this sequence, and the durability of the vibrating plate 17 is improved.

In FIG. 13, in a case where the vibrating plate 17 is displaced in the piezoelectric device 13 (piezoelectric device 13 of which the nozzle density is 600 npi) that has the curvature radius of the curved surface 39 of 0 nm, and is capable of realizing the durability as a target at the time of discharge stability, a maximum stress value of the portion P1 of the vibrating plate 17 to which the stress is applied in a concentrated manner is indicated as 1. In other piezoelectric devices 13 of which the curvature radiuses of the curved surface 39 are different from each other, the maximum stress value that is applied to the portion P of the vibrating plate 17 to which the stress is applied in a concentrated manner is calculated as a relative value (relative stress value) with respect to the maximum value of the portion P1 of the vibrating plate 17 to which the stress is applied in a concentrated manner at the time of discharge stability. That is, the relative stress value illustrated by the vertical axis in FIG. 13 is a relative value obtained by dividing the maximum stress value that is applied to the portion P of the vibrating plate 17 by the maximum stress value which is applied to the portion P1 of the vibrating plate 17 at the time of discharge stability.

In FIG. 13, in a case where the relative stress value is 1, the piezoelectric device 13 has the durability as a target, and the vibrating plate 17 also has the durability as a target.

In a case where the relative stress value is smaller than 1, the stress which is applied to the vibrating plate 17 in the vicinity of the end portion 10 becomes small in comparison with that of a case where the relative stress value is 1, and thus, the vibrating plate 17 in the vicinity of the end portion 10 is less likely to deteriorate. Accordingly, in a case where the relative stress value is smaller than 1, the durability of the vibrating plate 17 is improved, the durability of the piezoelectric device 13 is improved, and the piezoelectric device 13 has the durability as a target, in comparison with a case where the relative stress value is 1.

In a case where the relative stress value is larger than 1, the stress which is applied to the vibrating plate 17 in the vicinity of the end portion 10 becomes large in comparison with a case where the relative stress value is 1, and thus, the vibrating plate 17 in the vicinity of the end portion 10 is likely to deteriorate. Accordingly, in a case where the relative stress value is larger than 1, the durability of the vibrating plate 17 is lowered, and the durability of the piezoelectric device 13 is lowered, and the piezoelectric device 13 has the durability as a target, in comparison with a case where the relative stress value is 1.

In this manner, it is possible to evaluate the durability of the vibrating plate 17, and the durability of the piezoelectric device 13, from the relative stress value.

In the piezoelectric device 13 of which the nozzle density is 600 npi, as illustrated by the one-dot chain line in FIG. 13, in a case where the piezoelectric element 18 is driven at the time of discharge stability, the relative stress value that is applied to the portion P on which the stress of the vibrating plate 17 is concentrated becomes small in sequence of a case where the curvature radius of the curved surface 39 is 0 nm, a case where the curvature radius of the curved surface 39 is 60 nm, a case where the curvature radius of the curved surface 39 is 222 nm, and a case where the curvature radius of the curved surface 39 is 297 nm, the stress that is applied to the portion P of the vibrating plate 17 to which the stress is applied in a concentrated manner is weakened in this sequence, the durability of the vibrating plate 17 is improved, and the durability of the piezoelectric device 13 is improved. Therefore, since the relative stress value is smaller than 1 even in any condition, it is possible to realize the durability as a target in the piezoelectric device 13.

In order to prevent the deterioration (fatigue failure) of the vibrating plate 17, and to improve the durability of the vibrating plate 17, it is preferable that the curvature radius of the curved surface 39 be large.

In the piezoelectric device 13 of which the nozzle density is 600 npi, as illustrated by the broken line in FIG. 13, in a case where the piezoelectric element 18 is driven at the time of discharge instability, the relative stress value that is applied to the portion P on which the stress of the vibrating plate 17 is concentrated becomes small in sequence of a case where the curvature radius of the curved surface 39 is 0 nm, a case where the curvature radius of the curved surface 39 is 60 nm, a case where the curvature radius of the curved surface 39 is 222 nm, and a case where the curvature radius of the curved surface 39 is 297 nm, the durability of the vibrating plate 17 is improved in this sequence, and the durability of the piezoelectric device 13 is improved.

However, in a case where the curvature radius of the curved surface 39 is 0 nm, the relative stress value that is applied to the portion P on which the stress of the vibrating plate 17 is concentrated is 1.47 to be larger than 1, thereby, it is difficult to realize the durability as a target in the vibrating plate 17, and it is difficult to realize the durability as a target in the piezoelectric device 13.

On the other hand, if the curvature radius of the curved surface 39 is 60 nm or more, the relative stress value that is applied to the portion P on which the stress of the vibrating plate 17 is concentrated is smaller than 1, thereby, the vibrating plate 17 has the durability as a target, and the piezoelectric device 13 has the durability as a target.

Therefore, in a case where the discharge is not stable (case where the bubbles are mixed into the pressure chamber 26 or the nozzle 27), it is preferable that the curvature radius of the curved surface 39 be 60 nm or more, so that the piezoelectric device 13 of which the nozzle density is 600 npi and the vibrating plate 17 have the durability as a target. That is, if the curvature radius of the curved surface 39 is 60 nm or more, the piezoelectric device 13 of which the nozzle density is 600 npi, and the vibrating plate 17 have the durability as a target, in both of a case where the discharge is not stable (case where the bubbles are mixed into the pressure chamber 26 or the nozzle 27) and a case where the discharge is stable (case where the bubbles are not mixed into the pressure chamber 26 or the nozzle 27).

In the piezoelectric device 13 of which the nozzle density is 300 npi, the displacement (relative stress value) of the vibrating plate 17 becomes small, in comparison with that of the piezoelectric device 13 of which the nozzle density is 600 npi. Thus, if the piezoelectric device 13 of which the nozzle density is 600 npi has the durability as a target, the piezoelectric device 13 of which the nozzle density is 300 npi also has the durability as a target.

Accordingly, it is preferable that the curvature radius of the curved surface 39 be 60 nm or more, so that the piezoelectric device 13 of which the nozzle density is 300 npi or more and 600 npi or less has the durability as a target.

In FIG. 14, a pitch interval A is an interval between the piezoelectric element 18 (pressure chamber 26) and the piezoelectric element 18 (adjacent pressure chamber 26) which is adjacent thereto in FIG. 3. A width B of the pressure chamber 26 is the dimension L2 of the pressure chamber 26 in the sub scanning direction in FIG. 9. A width C of the partition wall 25 is a dimension (dimension in the sub scanning direction) of the partition wall 25 in FIG. 3, and is a difference between the pitch interval A and the width B of the pressure chamber 26, as expressed in Formula (1).

$$C=A-B \tag{1}$$

A curvature radius D is the radius of the approximated circle obtained by approximating the contour of the cross section of the curved surface 39 to the circle in FIG. 4. A bonding width E of the vibrating plate 17 is a length of a portion which is bonded to the partition wall 25 in the vibrating plate 17 in FIG. 3, and is expressed by Formula (2). The area of the portion which is bonded to the partition wall 25 in the vibrating plate 17 is proportional to the length of the portion which is bonded to the partition wall 25 in the vibrating plate 17.

$$E=C-2D \tag{2}$$

A ratio F of the bonding width to the partition wall 25 is an occupancy rate of the portion which is bonded to the vibrating plate 17 in the partition wall 25, and is expressed by Formula (3).

$$F=E/C \tag{3}$$

A sign of C in determination of the bonding strength of the vibrating plate 17 indicates a case where the vibrating plate 17 is peeled off from the partition wall 25 earlier than a period in which the deterioration (fatigue failure) of the vibrating plate 17 is generated due to the stress concentration in a case where the piezoelectric element 18 is driven by a known drive method, and the vibrating plate 17 vibrates. Therefore, in a case where the determination is the sign of C, the vibrating plate 17 is peeled off from the partition wall 25 earlier than the period in which the deterioration (fatigue failure) of the vibrating plate 17 is made due to the stress concentration, and thus, the piezoelectric device 13 does not have the durability as a target.

A sign of B in the determination of the bonding strength of the vibrating plate 17 indicates a case where the vibrating plate 17 is peeled off from the partition wall 25 for a period that is the same as the period in which the deterioration (fatigue failure) of the vibrating plate 17 is generated due to the stress concentration in a case where the piezoelectric element 18 is driven by a known drive method, and the vibrating plate 17 vibrates. Therefore, in a case where the determination is the sign of B, the period in which the vibrating plate 17 is peeled off from the partition wall 25 is the same as the period in which the deterioration (fatigue failure) of the vibrating plate 17 is made due to the stress concentration, and the piezoelectric device 13 has the durability as a target.

A sign of A in the determination of the bonding strength of the vibrating plate 17 indicates a case where the vibrating plate 17 is peeled off from the partition wall 25 later than the period in which the deterioration (fatigue failure) of the vibrating plate 17 is generated due to the stress concentration in a case where the piezoelectric element 18 is driven by a known drive method, and the vibrating plate 17 vibrates. Therefore, in a case where the determination is the sign of A, the vibrating plate 17 is peeled off from the partition wall 25 later than the period in which the deterioration (fatigue failure) of the vibrating plate 17 is made due to the stress concentration, and thus, the piezoelectric device 13 has the durability as a target.

As illustrated in FIG. 14, if the curvature radius of the curved surface 39 is 1200 nm, and the bonding width E of the vibrating plate 17 is 2.9 μm, the strength determination of the vibrating plate 17 is B, and the deterioration of the vibrating plate 17 and the peeling of the vibrating plate 17 from the partition wall 25 are generated in the same period. The durability of the piezoelectric device 13 depends on both of the period in which the deterioration of the vibrating plate 17 is generated and the period in which the peeling of the vibrating plate 17 from the partition wall 25 is generated. Thus, even if the curvature radius of the curved surface 39 is increased up to 1200 nm, and the durability of the vibrating plate 17 is improved, in a case where the period in which the peeling of the vibrating plate 17 from the partition wall 25 is generated varies, there are concerns that the vibrating plate 17 does not have the durability, and the piezoelectric device 13 does not have the durability.

In a case where the curvature radius of the curved surface 39 is in a scope of 60 nm to 1000 nm, and the bonding width E of the vibrating plate 17 is in a scope of 3.3 μm to 5.2 μm, the strength determination of the vibrating plate 17 is A, and the vibrating plate 17 is peeled off from the partition wall 25 later than the deterioration of the vibrating plate 17. In this case, if the curvature radius of the curved surface 39 is increased to be 60 nm to 1000 nm, even in a case where the period in which the peeling of the vibrating plate 17 from the partition wall 25 is generated varies, the vibrating plate stably has the durability as a target, and the piezoelectric device 13 stably has the durability as a target.

Accordingly, it is preferable to make a configuration (configuration in which the curvature radius of the curved surface 39 is in the scope of 60 nm to 1000 nm) in which the curvature radius of the curved surface 39 is 1000 nm or less, so that the vibrating plate 17 has the durability as a target, and the piezoelectric device 13 has the durability as a target.

As described above, in the simulation evaluation illustrated in FIG. 13, it is preferable that the curvature radius of the curved surface 39 be 60 nm or more, so that the piezoelectric device 13 of which the nozzle density is 600 npi has the durability as a target.

However, if the curvature radius of the curved surface 39 is made too large, the bonding width E of the vibrating plate 17 becomes too short, or the area of the portion which is bonded to the partition wall 25 in the vibrating plate 17 becomes too small, and thus, the vibrating plate 17 is likely to be peeled off from the partition wall 25, and the vibrating plate 17 early deteriorates due to the peeling of the vibrating plate 17 from the partition wall 25. Therefore, it is preferable that the curvature radius of the curved surface 39 be 1000 nm or less, so that the vibrating plate 17 has the durability as a target.

Accordingly, in the piezoelectric device 13 of which the nozzle density is 600 npi, it is preferable that the curvature radius of the curved surface 39 be in the scope of 60 nm to 1000 nm, so that the vibrating plate 17 and the piezoelectric device 13 have the durability as a target.

In the piezoelectric device 13 of which the nozzle density is 300 npi, the bonding width E of the vibrating plate 17 becomes long, and the area of the portion which is bonded to the partition wall 25 in the vibrating plate 17 becomes large, in comparison with those of the piezoelectric device 13 of which the nozzle density is 600 npi. Thus, in the piezoelectric device 13 of which the nozzle density is 600 npi, if the vibrating plate 17 and the piezoelectric device 13 have the durability as a target in a case where the curvature radius of the curved surface 39 is 1000 nm or less, even in the piezoelectric device 13 of which the nozzle density is 300 npi, the vibrating plate 17 and the piezoelectric device 13 have the durability as a target in a case where the curvature radius of the curved surface 39 is 1000 nm or less.

Accordingly, it is preferable that the curvature radius of the curved surface 39 be in the scope of 60 nm to 1000 nm, so that the piezoelectric device 13 of which the nozzle density is 300 npi or more and 600 npi or less has the durability as a target. Since the nozzle 27 and the pressure chamber 26 (pressure chamber empty portion 32) correspond to each other at a ratio of 1:1, it is preferable that the curvature radius of the curved surface 39 be in the scope of 60 nm to 1000 nm, in the piezoelectric device 13 in which the number of nozzles 27 per one inch is 300 or more and 600 or less, that is, in the piezoelectric device 13 in which the number of pressure chamber empty portions 32 per one inch is 300 or more and 600 or less.

In the piezoelectric device 13 of which the nozzle density is larger than 600 npi, the bonding width E of the vibrating plate 17 becomes short, and the area of the portion which is bonded to the partition wall 25 in the vibrating plate 17 becomes small, in comparison with those of the piezoelectric device 13 of which the nozzle density is 600 npi, and thus, it is preferable that the curvature radius of the curved surface 39 be 1000 nm or less, so that the vibrating plate 17 and the piezoelectric device 13 have the durability as a target.

Second Embodiment

Figure 15:
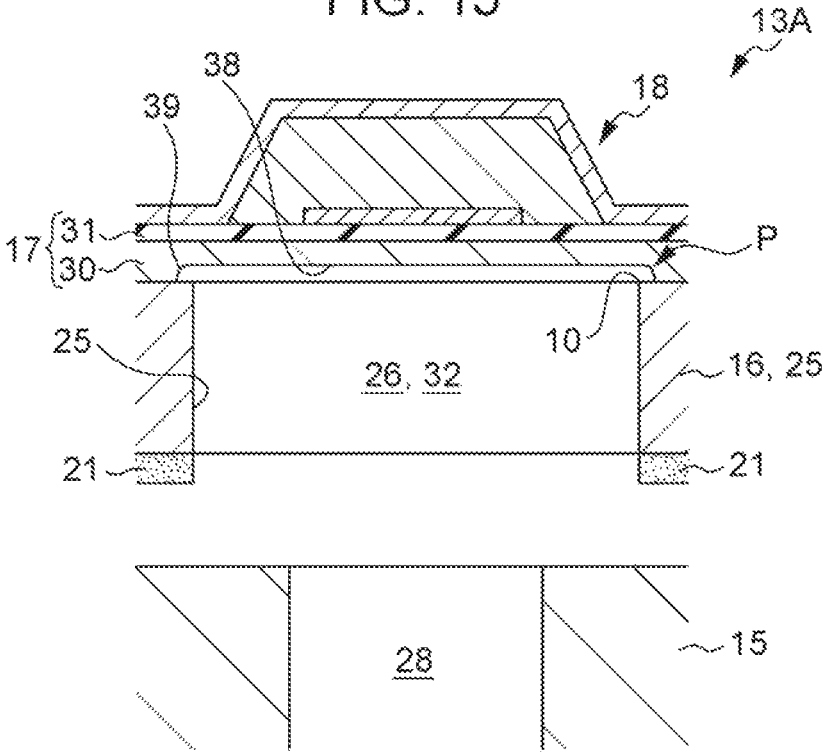
FIG. 15 is an outline diagram of a process of bonding a pressure chamber forming substrate and a communicating substrate, in a piezoelectric device according to a second embodiment.
Figure 16:
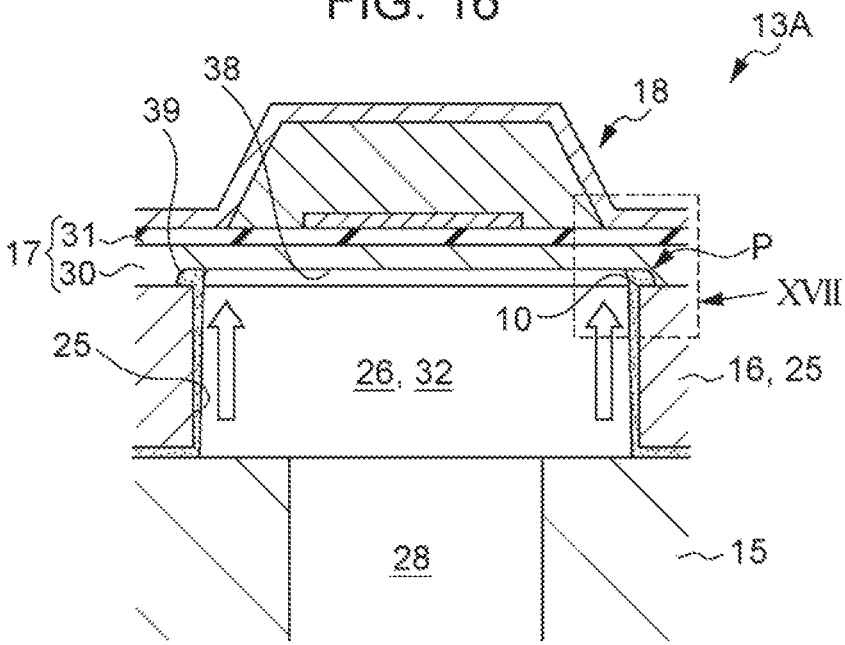
FIG. 16 is an outline diagram of the process of bonding the pressure chamber forming substrate and the communicating plate, in the piezoelectric device according to the second embodiment.
Figure 17:
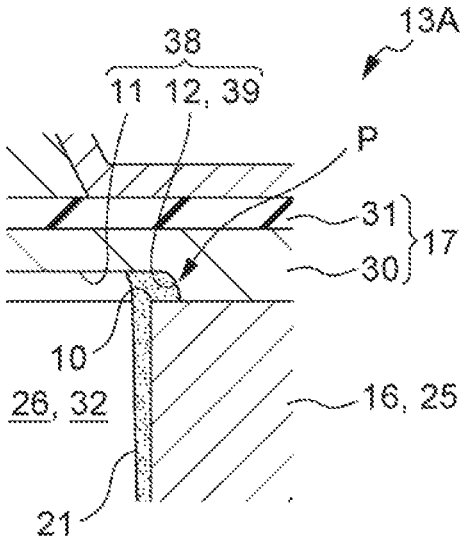
FIG. 17 is an outline diagram illustrating a state of a concave portion which is formed in the vibrating plate of the piezoelectric device according to the second embodiment.

FIGS. 15 and 16 are diagrams corresponding to FIG. 3, and are outline diagrams of a process of bonding a pressure chamber forming substrate and a communicating substrate, in a piezoelectric device according to a second embodiment. In FIGS. 15 and 16, one of the plurality of pressure chambers 26 or piezoelectric elements 18 is illustrated in the drawing. FIG. 17 is a diagram corresponding to FIG. 4, and is an outline diagram illustrating a state of a concave portion which is formed in a vibrating plate of the piezoelectric device according to the second embodiment.

In a piezoelectric device 13A according to the second embodiment, a space (pressure chamber empty portion 32) which becomes the pressure chamber 26, and the curved surface 39 of the vibrating plate 17 are covered with the adhesive 21 which is an example of the "resin". In the piezoelectric device 13 according to the first embodiment, the space (pressure chamber empty portion 32) which becomes the pressure chamber 26, and the curved surface 39 of the vibrating plate 17 are not covered with the adhesive 21. This point is a point that the second embodiment is mainly different from the first embodiment.

Hereinafter, an outline of the piezoelectric device 13A according to the second embodiment will be described with the point which is different from that of the first embodiment as a center, with reference to FIGS. 15 to 17. The same marks are attached to the same configuration components as those in the first embodiment, and the repeated description thereof will be omitted.

As illustrated in FIG. 15, in the process of bonding the pressure chamber forming substrate 16 and the communicating substrate 15, first, the adhesive 21 having fluidity is transferred to a bonding surface of the pressure chamber forming substrate 16 to the communicating substrate 15. Subsequently, the communicating substrate 15 of a bonding partner is stuck to the surface to which the adhesive 21 is transferred. Therefore, as illustrated in FIG. 16, the adhesive 21 protruding from between the pressure chamber forming substrate 16 and the communicating substrate 15 flows in a direction which is indicated by an arrow in the drawing due to a capillary phenomenon, and covers the side wall of the pressure chamber empty portion 32, and the curved surface 39 of the concave portion 38 which is formed in the vibrating plate 17. The adhesive 21 is cured, thereby, the adhesive 21 (resin) covering the curved surface 39 of the concave portion 38 which is formed in the vibrating plate 17 is formed.

That is, if the amount of the adhesive 21 which is transferred to the bonding surface of the pressure chamber forming substrate 16 is increased, it is possible to increase the amount of the adhesive 21 flowing in the direction which is indicated by the arrow in the drawing due to the capillary phenomenon. For example, if the amount of the adhesive 21 which is transferred to the bonding surface of the pressure chamber forming substrate 16 is increased, it is possible to form the adhesive 21 (resin) covering the whole surface of the curved surface 39 of the concave portion 38 which is formed in the vibrating plate 17.

If the amount of the adhesive 21 which is transferred to the bonding surface of the pressure chamber forming substrate 16 is decreased, it is possible to decrease the amount of the adhesive 21 flowing in the direction which is indicated by the arrow in the drawing due to the capillary phenomenon. For example, if the amount of the adhesive 21 which is transferred to the bonding surface of the pressure chamber forming substrate 16 is decreased, it is possible to form the adhesive 21 (resin) covering a portion of the curved surface 39 of the concave portion 38 which is formed in the vibrating plate 17.

If the curved surface 39 of the concave portion 38 which is formed in the vibrating plate 17 is covered with the adhesive 21, the portion P on which the stress of the vibrating plate 17 is likely to be concentrated is reinforced by the adhesive 21, thereby, the fatigue failure of the vibrating plate 17 is less likely to be generated in the portion P to which the stress is applied in a concentrated manner, and it is possible to improve the durability of the vibrating plate 17. Furthermore, a portion which is bonded to the partition wall 25 in the vibrating plate 17 is reinforced by the adhesive 21, thereby, the bonding strength of the vibrating plate 17 to the partition wall 25 is enhanced, and it is possible to improve the durability of the vibrating plate 17.

Accordingly, if the curved surface 39 of the concave portion 38 which is formed in the vibrating plate 17 is covered with the adhesive 21, it is possible to improve the durability of the vibrating plate 17, and it is possible to improve the durability of the piezoelectric device 13A.

If a portion of the curved surface 39 of the concave portion 38 which is formed in the vibrating plate 17 is covered with the adhesive 21, and the portion P on which the stress of the vibrating plate 17 is likely to be concentrated is reinforced by the adhesive 21, the fatigue failure of the vibrating plate 17 is less likely to be generated in the portion P to which the stress is applied in a concentrated manner, and the durability of the vibrating plate 17 is improved, and thus, the adhesive 21 may be configured to cover a portion of the curved surface 39 of the concave portion 38 which is formed in the vibrating plate 17.

That is, the adhesive 21 may be configured to cover the whole of the curved surface 39 of the concave portion 38 which is formed in the vibrating plate 17, or may be configured to cover a portion of the concave portion 38 which is formed in the vibrating plate 17.

In the above description, a configuration in which the ink that is one kind of the liquid is discharged from the nozzle 27 by displacing the movable region that divides one surface of the space (pressure chamber 26) which is formed in the pressure chamber forming substrate 16 is exemplified, but the invention is not limited thereto. It is possible to apply the invention to the piezoelectric device in which the plurality of substrates are bonded to each other with the adhesive as long as the configuration thereof has the movable region. For example, it is possible to apply the invention to a sensor for detecting the pressure change, the vibration, or the displacement of the movable region.

The space of which one surface is divided by the movable region is not limited to a space through which the liquid circulates.

In the first embodiment and the second embodiment, the recording head (ink jet recording head) 2 is described as an example of the liquid discharge head, but the invention is widely applied to the liquid discharge head as a target in general, and it is possible to apply the invention to a coloring material discharge head which is used for manufacturing a color filter such as a liquid crystal display, an electrode material discharge head which is used for forming an electrode such as an organic electro luminescence (EL) display or a field emission display (FED), a bioorganic material discharge head which is used for manufacturing a biochip (biochemical element), or the like.

In the coloring material discharge head for a display manufacturing apparatus, a solution of each coloring material of red (R), green (G), or blue (B) is discharged, as one kind of the liquid. In the electrode material discharge head for an electrode forming apparatus, a liquid-shaped electrode material is discharged, as one kind of the liquid. In the bioorganic material discharge head for a chip manufacturing apparatus, a solution of the bioorganic material is discharged, as one kind of the liquid.

What is claimed is:

1. A piezoelectric device comprising:

a substrate in which a space is formed;

an elastic layer that is formed on the substrate, corresponding to the space; and a piezoelectric element that is formed on the elastic layer, corresponding to the space, wherein the elastic layer is provided with a concave portion having a bottom portion which is overlapped with the space, and is larger than the space in a planar view, and a wall portion which surrounds the bottom portion, on the space side, the wall portion has a curved surface that is inclined to widen in a direction toward the space from the bottom portion, and a curvature radius of the curved surface is 60 nm to 1000 nm.

2. The piezoelectric device according to claim 1, wherein a portion of the curved surface is covered with a resin.

3. A liquid discharge head comprising:

the piezoelectric device according to claim 2, wherein a liquid with which the space is filled is discharged, by a drive of the piezoelectric element.

4. The piezoelectric device according to claim 1, wherein the substrate is formed with a plurality of the spaces side by side, and the number of the spaces per one inch is 300 or more and 600 or less.

5. A liquid discharge head comprising:

the piezoelectric device according to claim 4, wherein a liquid with which the space is filled is discharged, by a drive of the piezoelectric element.

6. A liquid discharge head comprising:

the piezoelectric device according to claim 1, wherein a liquid with which the space is filled is discharged, by a drive of the piezoelectric element.

7. A liquid discharge apparatus comprising:

the liquid discharge head according to claim 6.

* * * * *